US011001070B2

(12) United States Patent
Nishimura

(10) Patent No.: US 11,001,070 B2
(45) Date of Patent: May 11, 2021

(54) INDEPENDENT RESERVOIRS FOR SUPPLYING A PRINT FLUID TO A FLOW-THROUGH PRINTHEAD

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/913,795

(22) Filed: Mar. 6, 2018

(65) Prior Publication Data

US 2019/0275802 A1 Sep. 12, 2019

(51) Int. Cl.

| | |
|---|---|
| ***B41J 2/14*** | (2006.01) |
| ***B41J 2/175*** | (2006.01) |
| ***B41J 2/155*** | (2006.01) |
| ***B41J 2/18*** | (2006.01) |

(52) U.S. Cl.

CPC ..... *B41J 2/17566* (2013.01); *B41J 2/1433* (2013.01); *B41J 2/14274* (2013.01); *B41J 2/155* (2013.01); *B41J 2/175* (2013.01); *B41J 2/1752* (2013.01); *B41J 2/18* (2013.01); *B41J 2202/12* (2013.01)

(58) Field of Classification Search

CPC ..... B41J 2/14274; B41J 2/14233; B41J 2/175
See application file for complete search history.

(56) References Cited

U.S. PATENT DOCUMENTS

| | | | | |
|---|---|---|---|---|
| 9,994,040 | B2 * | 6/2018 | Karita | B41J 2/175 |
| 2008/0273063 | A1 * | 11/2008 | Wouters | B41J 2/1707 347/85 |
| 2009/0102879 | A1 | 4/2009 | Katada et al. | |
| 2011/0080456 | A1 * | 4/2011 | Shibata | B41J 2/14233 347/92 |
| 2012/0200619 | A1 | 8/2012 | Bibl | |
| 2015/0306875 | A1 * | 10/2015 | Nishimura | B41J 2/14274 347/71 |
| 2016/0207317 | A1 | 7/2016 | Jimenez et al. | |

FOREIGN PATENT DOCUMENTS

| | | | |
|---|---|---|---|
| EP | 2628599 | A1 | 8/2013 |
| EP | 2995458 | A1 | 3/2016 |
| WO | 2008108245 | A1 | 9/2008 |

OTHER PUBLICATIONS

European Search Report; Application EP19153584; dated Aug. 7, 2019.

* cited by examiner

*Primary Examiner* — Lam S Nguyen
(74) *Attorney, Agent, or Firm* — Duft & Bornsen, PC

(57) ABSTRACT

Apparatus and method for providing a print fluid to a flow-through printhead. The printhead has a row of jetting channels configured to jet droplets of a print fluid, a supply manifold fluidly coupled to the row of jetting channels, and a return manifold fluidly coupled to the row of jetting channels. A first reservoir is fluidly coupled to the supply manifold, and a second reservoir is fluidly coupled to the return manifold. The first reservoir and the second reservoir are fluidly isolated except through the printhead.

20 Claims, 7 Drawing Sheets

INDEPENDENT RESERVOIRS FOR SUPPLYING A PRINT FLUID TO A FLOW-THROUGH PRINTHEAD

FIELD OF THE INVENTION

The following disclosure relates to the field of image formation, and in particular, to the supply of a print fluid to printheads.

BACKGROUND

Image formation is a procedure whereby a digital image is recreated on a medium by propelling droplets of ink or another type of print fluid onto a medium, such as paper, plastic, a substrate for 3D printing, etc. Image formation is commonly employed in apparatuses, such as printers (e.g., inkjet printer), facsimile machines, copying machines, plotting machines, multifunction peripherals, etc. The core of a typical jetting apparatus or image forming apparatus is one or more liquid-droplet ejection heads (referred to generally herein as "printheads") having nozzles that discharge liquid droplets, a mechanism for moving the printhead and/or the medium in relation to one another, and a controller that controls how liquid is discharged from the individual nozzles of the printhead onto the medium in the form of pixels.

A typical printhead includes a plurality of nozzles aligned in one or more rows along a discharge surface of the printhead. Each nozzle is part of a "jetting channel", which includes the nozzle, a pressure chamber, and an actuator, such as a piezoelectric actuator. A printhead also includes a drive circuit that controls when each individual jetting channel fires based on image data. To jet from a jetting channel, the drive circuit provides a jetting pulse to the actuator, which causes the actuator to deform a wall of the pressure chamber. The deformation of the pressure chamber creates pressure waves within the pressure chamber that eject a droplet of print fluid (e.g., ink) out of the nozzle.

Shuttle-type printers are a class of printers having a movable shuttle or carriage assembly that reciprocates back and forth across a medium. A printhead is mounted on the carriage assembly, and jetting from the printhead is synchronized with movement of the carriage assembly to print desired images. Movement of the carriage assembly is also synchronized with a medium transfer mechanism that advances the medium through the printer.

It remains an issue for manufacturers to find effective ways to supply ink or another print fluid to printheads in image forming apparatuses, such as shuttle-type printers.

SUMMARY

Embodiments described herein include an apparatus having independent reservoirs that supply a print fluid to the printhead. The printhead as described herein is a flow-through type of printhead, where a print fluid is able to flow from a supply manifold through jetting channels to a return manifold, or vice-versa. The print fluid, which is not ejected from nozzles of the jetting channels, circulates through the jetting channels and into the return manifold. In this embodiment, the reservoirs are fluidly coupled through the printhead, which means that the print fluid is able to flow from one reservoir to another through the printhead. There are no additional fluid couplings between the reservoirs, so the reservoirs are fluidly isolated but for the printhead. A differential pressure between the reservoirs creates a flow of print fluid through the printhead, which supplies the jetting channels with the print fluid used for jetting, and also re-circulates the non-jetted print fluid through the jetting channels. The print fluid supplied by one of the reservoirs to the print head is accumulated in the other reservoir when not jetted from the jetting channels. The differential pressure between the reservoirs may also be reversed periodically or in response to a trigger to reverse the flow of print fluid, and balance the fluid level in the reservoirs. Thus, no additional circulating unit is needed between the reservoirs, such as a circulation tube, a pump, a degas module, etc. This advantageously simplifies the mechanism used to supply a print fluid to the printhead.

One embodiment includes an apparatus comprising a flow-through printhead having a row of jetting channels configured to jet droplets of a print fluid, a supply manifold fluidly coupled to the row of jetting channels, and a return manifold fluidly coupled to the row of jetting channels. The apparatus further includes a first reservoir fluidly coupled to the supply manifold, and a second reservoir fluidly coupled to the return manifold. The first reservoir and the second reservoir are fluidly isolated except through the printhead.

Another embodiment includes a carriage assembly configured to reciprocate along scan directions in relation to a medium. The carriage assembly comprises a flow-through printhead having a row of jetting channels configured to eject a print fluid, a supply manifold fluidly coupled to the row of jetting channels, and a return manifold fluidly coupled to the row of jetting channels. The carriage assembly further comprises a first reservoir fluidly coupled to the supply manifold of the printhead, and a second reservoir fluidly coupled to the return manifold of the printhead, and fluidly coupled to the first reservoir solely through the printhead. The first reservoir and the second reservoir are mounted in-line with the row of jetting channels.

Another embodiment comprises a method of supplying a print fluid to a flow-through printhead having a row of jetting channels configured to eject a print fluid, a supply manifold fluidly coupled to the row of jetting channels, and a return manifold fluidly coupled to the row of jetting channels. The method includes fluidly coupling a first reservoir to the supply manifold of the printhead, and fluidly coupling a second reservoir to the return manifold of the printhead. The first reservoir and the second reservoir are fluidly isolated except through the printhead. The method includes creating a first pressure differential between the first reservoir and the second reservoir to produce a flow of the print fluid between the first reservoir and the second reservoir through the printhead. The method further includes determining whether to reverse the flow of the print fluid, and creating a second pressure differential between the first reservoir and the second reservoir to reverse the flow of the print fluid between the first reservoir and the second reservoir through the printhead.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
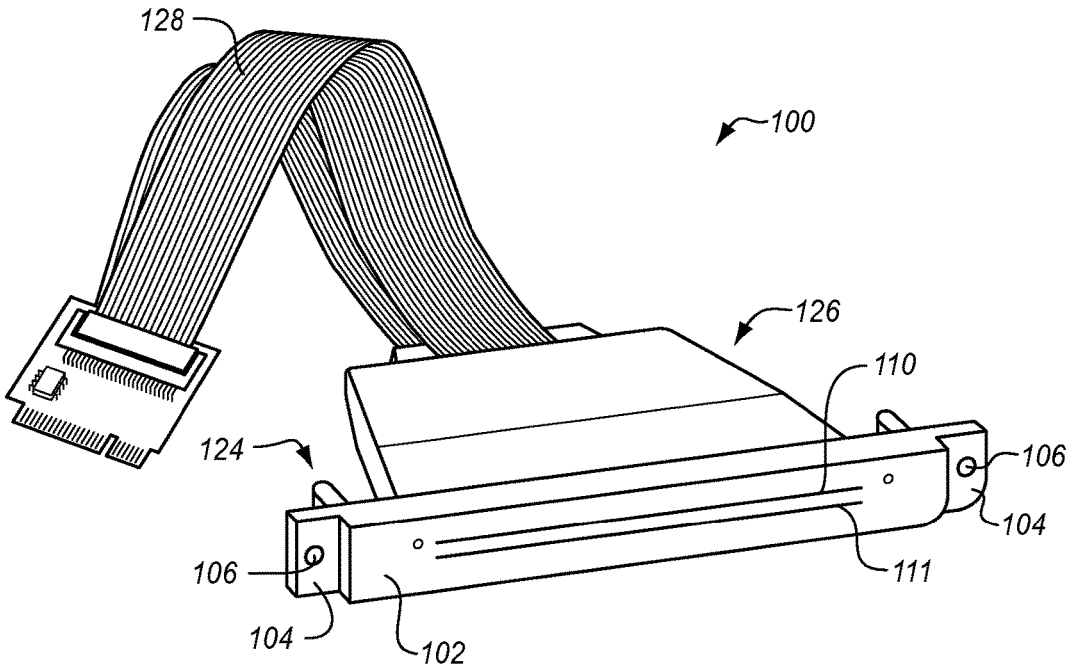
FIG. 1 is a perspective view of a printhead in an illustrative embodiment.

FIG. 1 is a perspective view of printhead 100 in an illustrative embodiment. Printhead 100 includes a nozzle plate 102, which represents the discharge surface of printhead 100. Nozzle plate 102 includes a plurality of nozzles that jet or eject droplets of print fluid onto a medium, such as paper, plastic, card stock, transparent sheets, a substrate for 3D printing, cloth, and the like. Nozzles of printheads 100 are arranged in one or more rows 110-111 so that ejection of print fluid from the nozzles causes formation of characters, symbols, images, layers of an object, etc., on the medium as printhead 100 and/or the medium are moved relative to one another. Although two rows 110-111 of nozzles are illustrated in FIG. 1, printhead 100 may include a single row of nozzles, three rows of nozzles, four rows of nozzles, etc. Printhead 100 also includes attachment members 104. Attachment members 104 are configured to secure printhead 100 to a jetting apparatus. Attachment members 104 may include one or more holes 106 so that printhead 100 may be mounted within a jetting apparatus by screws, bolts, pins, etc. Opposite nozzle plate 102 is the side of printhead 100 used for input/output (I/O) of print fluid, electronic signals, etc. This side of printhead 100 is referred to as the I/O side 124. I/O side 124 includes electronics 126 that connect to a controller board through cabling 128, such as a ribbon cable. Electronics 126 control how the nozzles of printhead 100 jet droplets in response to control signals provided by the controller board.

Figure 2A:
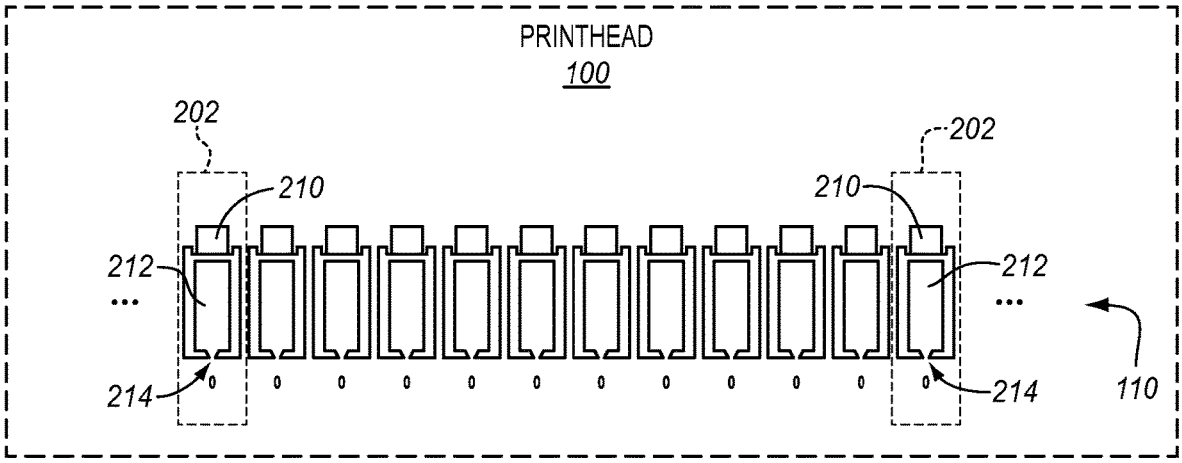
FIG. 2A is a schematic diagram of a row of jetting channels within a printhead in an illustrative embodiment.
Figure 2B:
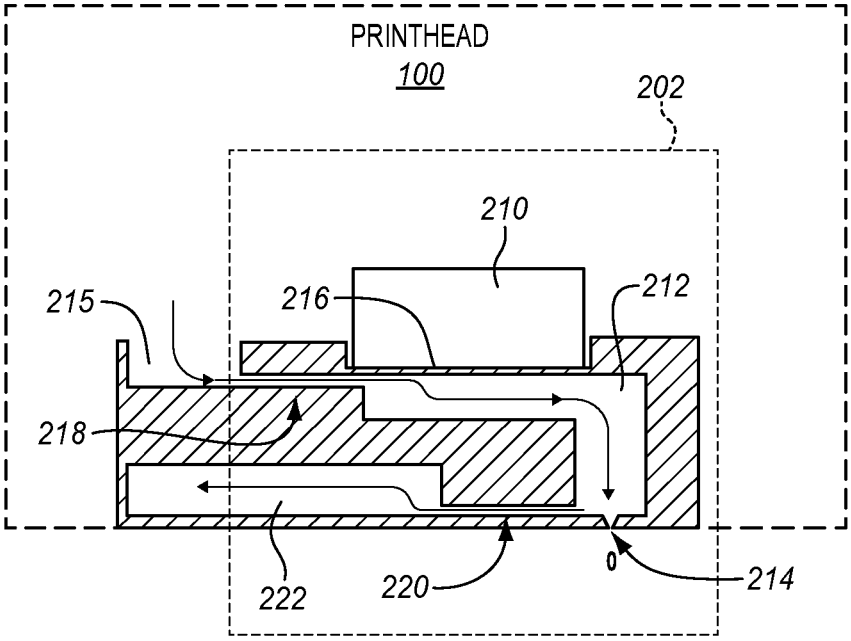
FIGS. 2B-2C are schematic diagrams of a jetting channel within a printhead in an illustrative embodiment.
Figure 2C:
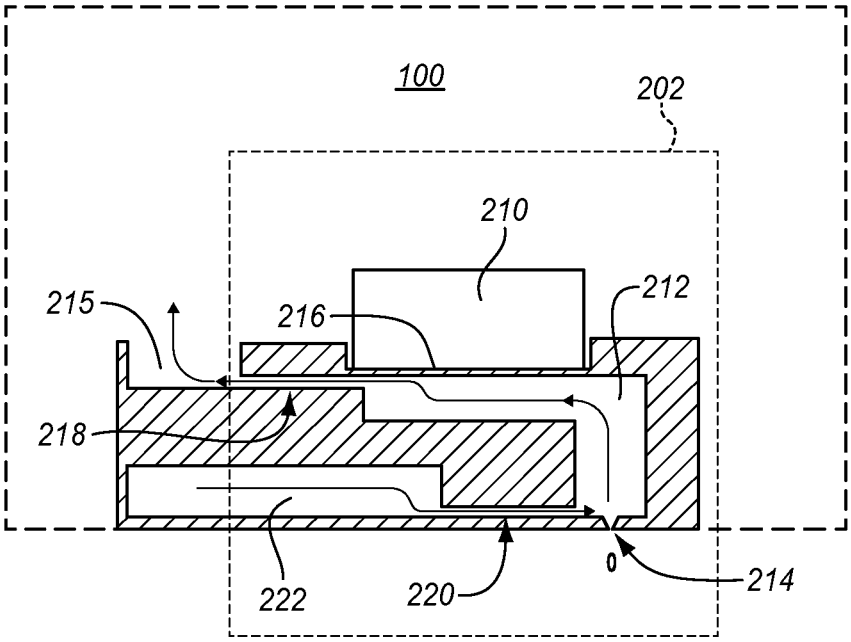

FIG. 2A is a schematic diagram of a row 110 of jetting channels 202 within printhead 100 in an illustrative embodiment. Printhead 100 includes multiple jetting channels 202 that are arranged in a line or row (e.g., row 110 in FIG. 1) along a length of printhead 100, and each jetting channel 202 in a row may have a similar configuration as shown in FIG. 2A. Each jetting channel 202 includes a piezoelectric actuator 210, a pressure chamber 212, and a nozzle 214. FIGS. 2B-2C are schematic diagrams of a jetting channel 202 within printhead 100 in an illustrative embodiment. The view in FIGS. 2B-2C is of a cross-section of jetting channel 202 across a width of printhead 100. Printhead 100 is a "flow-through" printhead or re-circulating printhead, which means that the print fluid may be re-circulated through printhead 100 past each nozzle 214. By having a flow-through design, a print fluid is able to flow from a supply manifold 215 to a return manifold 222 through jetting channels 202 in printhead 100. The arrow in FIG. 2B illustrates a flow path of a print fluid through jetting channel 202 in one direction. Although not shown in FIG. 2B, supply manifold 215 is coupled to a first independent reservoir, and return manifold 222 is coupled to a second independent reservoir. The print fluid flows from supply manifold 215 in printhead 100 and into pressure chamber 212 through a first restrictor 218. The first restrictor 218 fluidly connects pressure chamber 212 to supply manifold 215, and controls the flow of the print fluid into pressure chamber 212. One wall of pressure chamber 212 is formed with a diaphragm 216 that physically interfaces with piezoelectric actuator 210. Diaphragm 216 may comprise a sheet of semi-flexible material that vibrates in response to actuation by piezoelectric actuator 210. The print fluid flows through pressure chamber 212 and out of nozzle 214 in the form of a droplet in response to actuation by piezoelectric actuator 210. Piezoelectric actuator 210 is configured to receive a drive waveform, and to actuate or "fire" in response to a jetting pulse on the drive waveform. Firing of piezoelectric actuator 210 in jetting channel 202 creates pressure waves in pressure chamber 212 that cause jetting of a droplet from nozzle 214. The print fluid, which is not jetted from nozzle 214, flows from pressure chamber 212 into return manifold 222 through a second restrictor 220. The second restrictor 220 fluidly connects pressure chamber 212 to return manifold 222, and controls the flow of the print fluid into return manifold 222. As will be described in more detail below, the print fluid is able to flow through jetting channel 202 due to a pressure difference between the reservoir coupled to supply manifold 215 and the reservoir coupled to return manifold 222. For example, a positive pressure at the reservoir coupled to supply manifold 215 and a negative pressure at the reservoir coupled to return manifold 222 causes the print fluid to flow through jetting channel 202 as indicated in FIG. 2B. The flow of print fluid may also be reversed, as is shown in FIG. 2C.

The arrow in FIG. 2C illustrates a flow path of a print fluid within jetting channel 202 in a reverse direction. The print fluid flows from return manifold 222 and into pressure chamber 212 through the second restrictor 220. The print fluid flows through pressure chamber 212 and out of nozzle 214 in the form of a droplet in response to actuation by piezoelectric actuator 210. The print fluid, which is not jetted from nozzle 214, flows from pressure chamber 212 into supply manifold 215 through the first restrictor 218. A negative pressure at the reservoir coupled to supply manifold 215 and a positive pressure at the reservoir coupled to return manifold 222 causes the print fluid to flow through jetting channel 202 as indicated in FIG. 2C. The length of the first restrictor 218 may be the same as the length of the second restrictor 220 to allow for a reversal of flow in this manner.

Jetting channel 202 as shown in FIGS. 2A-2C is an example to illustrate a basic structure of a jetting channel, such as the actuator, pressure chamber, and nozzle. Other types of jetting channels are also considered herein. For example, some jetting channels may have a pressure chamber having a different shape than is illustrated in FIGS. 2A-2C. Some jetting channels may use another type of actuator other than a piezoelectric actuator.

Figure 3:
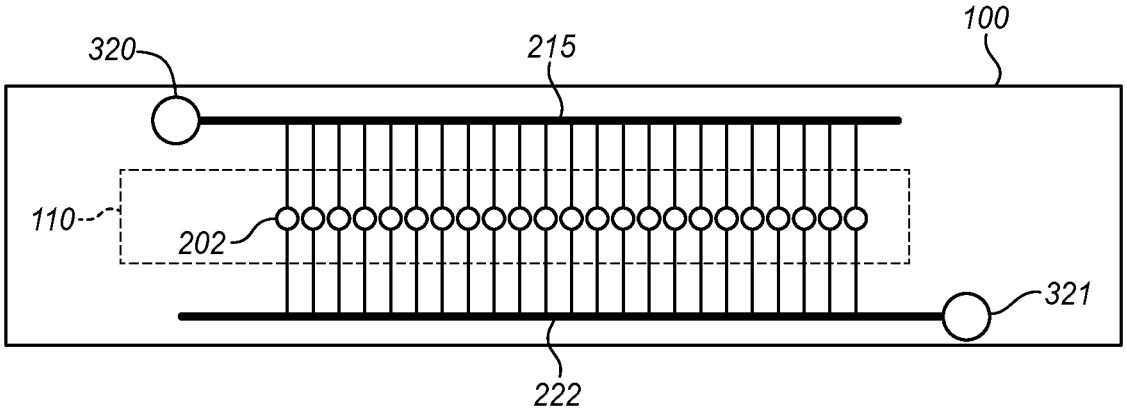
FIG. 3 is a schematic diagram of a printhead in an illustrative embodiment.

FIG. 3 is a schematic diagram of printhead 100 in an illustrative embodiment. In FIG. 3, jetting channels 202 are arranged in a straight line or row 110 within printhead 100. Supply manifold 215 and return manifold 222 are illustrated as each being fluidly coupled to jetting channels 202 in row 110. A manifold comprises a groove, duct, conduit, etc., disposed substantially parallel to the row 110 of jetting channels 202 within printhead 100, and fluidly coupled to each jetting channel 202. Because jetting channels 202 are flow-through, supply manifold 215 is fluidly coupled to return manifold 222 through jetting channels 202, and a print fluid may flow between supply manifold 215 and return manifold 222 through jetting channels 202.

Printhead 100 also includes fluid ports 320-321. Fluid port 320 provides a fluid pathway to supply manifold 215 of printhead 100. Fluid port 321 provides a fluid pathway to return manifold 222 of printhead 100. Fluid ports 320-321 may be connected (e.g., through a supply hose) to independent reservoirs.

Figure 4:
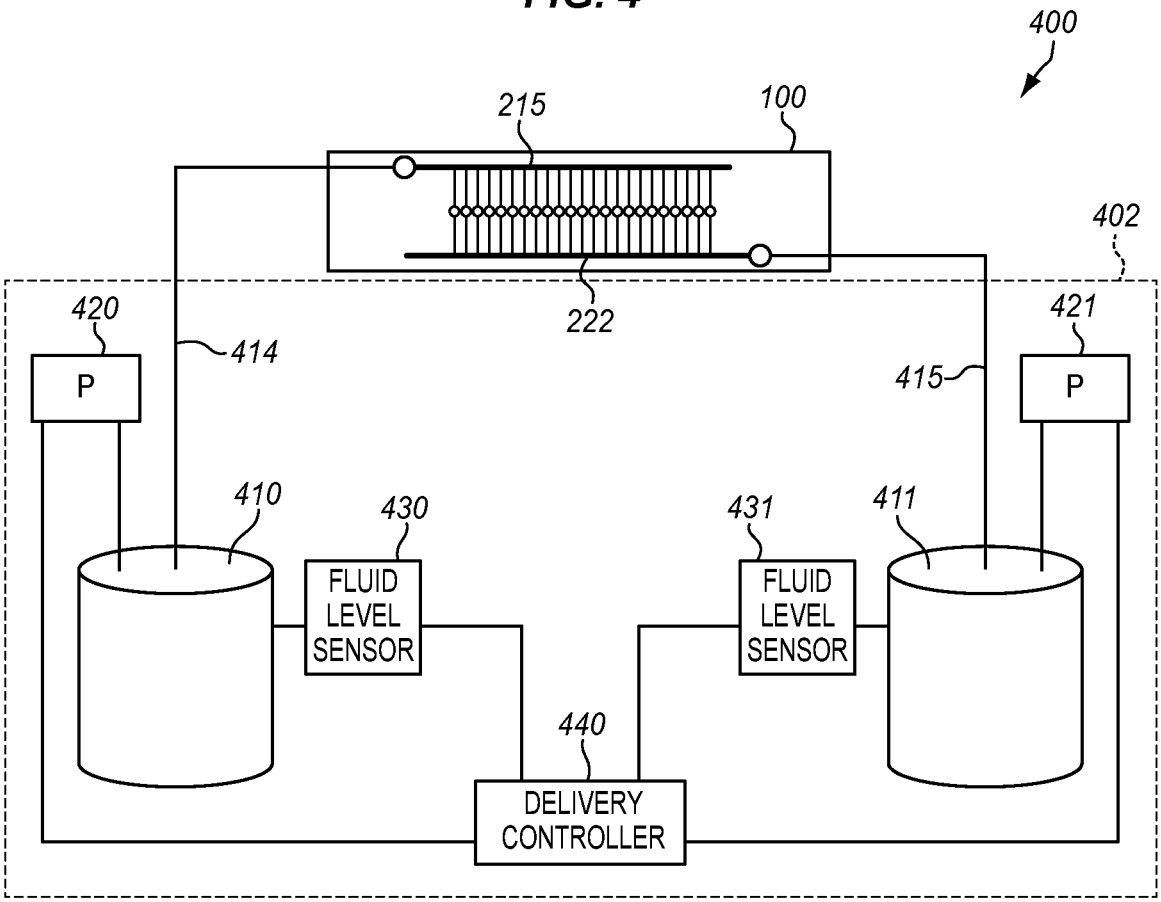
FIG. 4 is a schematic diagram of an image forming apparatus in an illustrative embodiment.

FIG. 4 is a schematic diagram of an image forming apparatus 400 in an illustrative embodiment. Image forming apparatus 400 includes printhead 100 and a fluid supply system 402 that is configured to supply a print fluid (e.g., ink) to printhead 100. Fluid supply system 402 includes at least two reservoirs 410-411. A reservoir 410-411 is a container, canister, tank, etc., that stores a print fluid, such as ink. Reservoir 410 is coupled to printhead 100 via supply tube 414, and reservoir 411 is coupled to printhead 100 via supply tube 415. Reservoirs 410-411 are referred to as "independent" in this embodiment, meaning that they are fluidly coupled solely through one or more flow-through printheads, such as printhead 100. In a conventional apparatus, a print fluid may be circulated from one reservoir to another through a circulating unit, which includes a circulation tube between the reservoirs, a circulation pump, degas modules, filters, etc. Because reservoirs 410-411 are independent in this embodiment, there is no distinct circulating unit such as this between reservoirs 410-411. The only flow path of a print fluid between reservoirs 410-411 is through printhead 100 (or other flow-through printheads that are coupled to reservoirs 410-411).

Fluid supply system 402 may further include a pressure source (P) 420-421 at reservoirs 410-411, respectively. A pressure source 420-421 is a mechanism configured to apply or regulate a pressure at a reservoir, such as a pressure valve. For example, a pressure source 420-421 may apply a negative pressure or a positive pressure at a reservoir, at a supply tube between a reservoir and a printhead, etc., to control a pressure at an inlet of printhead 100. Fluid supply system 402 may further include a fluid level sensor 430-431 at reservoirs 410-411, respectively. A fluid level sensor 430-431 is a device configured to determine or measure a fluid level within a reservoir 410-411, and provide output indicating the fluid level, such as in the form of an electronic signal. Fluid supply system 402 may further include a delivery controller 440, which comprises a component, circuit, processing device, etc., configured to control delivery of a print fluid from fluid supply system 402 to a printhead. Delivery controller 440 is communicatively coupled to pressure sources 420-421 and fluid level sensors 430-431. Delivery controller 440 may control one or more of pressure sources 420-421 to create a pressure differential between reservoirs 410-411 to produce a flow of the print fluid through printhead 100 in a first direction. Delivery controller 440 may control one or more of pressure sources 420-421 to reverse the pressure differential between reservoirs 410-411 to produce a flow of the print fluid through printhead 100 in a reverse direction. Delivery controller 440 may receive input from a user, from fluid level sensors 430-431, or from other components when controlling delivery of a print fluid to a printhead.

Due to the flow-through design of printhead 100, a print fluid is able to flow from supply manifold 215 through jetting channels 202 to return manifold 222, or vice-versa. The print fluid, which is not ejected from nozzles of the jetting channels 202, circulates through jetting channels 202 and into return manifold 222. If, in one example, delivery controller 440 controls pressure source 420 to apply a positive pressure at reservoir 410 and controls pressure source 421 to apply a negative pressure at reservoir 411, then the pressure differential will cause the print fluid to flow in one direction out of reservoir 410 through supply tube 414 and into supply manifold 215 of printhead 100. The print fluid that is not ejected from jetting channels 202 will flow through the jetting channels 202 into return manifold 222, and then out of printhead 100 through supply tube 415 and into reservoir 411. If the flow in this direction continues past a point, then the print fluid accumulating in reservoir 411 can flood reservoir 411. Thus, delivery controller 440 is able to reverse the flow of the print fluid. Delivery controller 440 may control pressure source 421 to apply a positive pressure at reservoir 411 and control pressure source 420 to apply a negative pressure at reservoir 410. This pressure differential will reverse the flow and cause the print fluid to flow in an opposite direction out of reservoir 411 through supply tube 415 and into return manifold 222 of printhead 100. The print fluid that is not ejected from jetting channels 202 will flow through the jetting channels 202 into supply manifold 215, and then out of printhead 100 through supply tube 414 and into reservoir 410. Delivery controller 440 may control a pressure differential between reservoirs 410-411 in a number of ways to influence the flow of print fluid. For instance, delivery controller 440 may control pressure sources 420-421 to apply positive pressures at both reservoirs 410-411, or to apply negative pressures at both reservoirs 410-411, as long as the pressure differential creates a flow in the desired direction and the pressure at nozzles 214 is slightly negative.

Delivery controller 440 may reverse the flow of the print fluid periodically within fluid supply system 402 to balance the fluid level in reservoirs 410-411. For example, delivery controller 440 may reverse the flow of the print fluid between reservoir 410 and reservoir 411 through printhead 100 after a time period. As the sizes of reservoirs 410-411 are known and the flow rate between the reservoirs is either known or may be estimated, delivery controller 440 may be programmed with a time interval for reversing flow of the print fluid. Delivery controller 440 may also receive an indicator of the fluid level in one or both of reservoirs 410-411 via fluid level sensors 430-431, and reverse the flow of the print fluid between reservoir 410 and reservoir 411 through printhead 100 based on the fluid level in reservoir 410 and/or reservoir 411.

One technical benefit of fluid supply system 402 is that the print fluid may be distributed between reservoirs 410-411 using the flow-through properties of printhead 100. Thus, no additional circulating unit is needed between reservoirs 410-411, such as a circulation tube, a pump, a degas module, etc. This advantageously simplifies fluid supply system 402, and avoids the need for additional equipment that is costly and takes up valuable space within an image forming apparatus.

Figure 5:
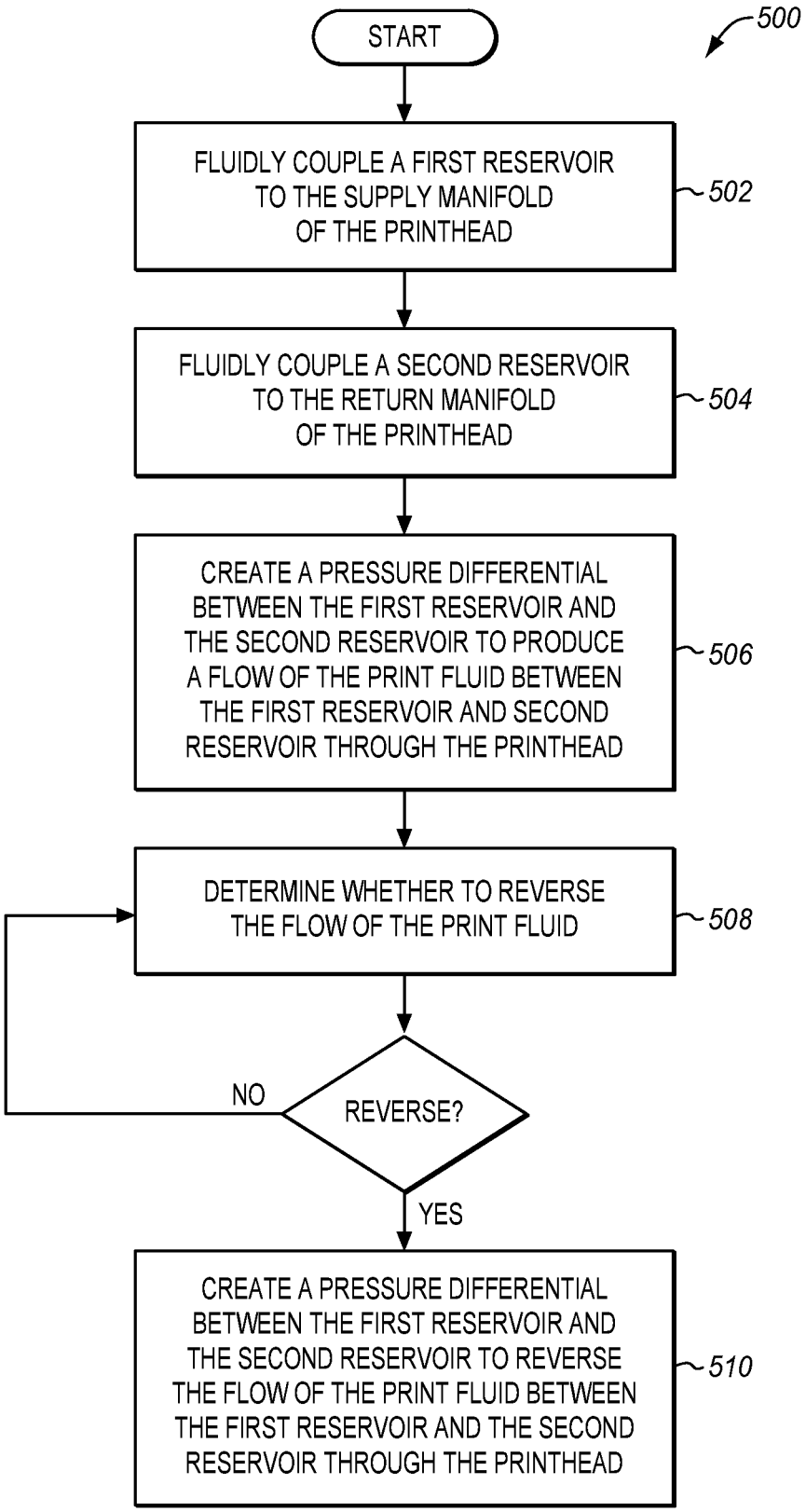
FIG. 5 is a flow chart illustrating a method of delivering a print fluid to a flow-through printhead in an illustrative embodiment.

FIG. 5 is a flow chart illustrating a method 500 of delivering a print fluid to a flow-through printhead in an illustrative embodiment. The steps of method 500 will be described with reference to fluid supply system 402 in FIG. 4, but those skilled in the art will appreciate that method 500 may be performed in other devices. The steps of the flow charts described herein are not all inclusive and may include other steps not shown, and the steps may be performed in an alternative order.

For method 500, one reservoir (e.g., reservoir 410) is fluidly coupled to supply manifold 215 of printhead 100 (step 502). For example, reservoir 410 may be coupled to supply port 320 (see FIG. 3) on printhead 100 via supply tube 414. Another reservoir (e.g., reservoir 411) is fluidly coupled to return manifold 222 of printhead 100 (step 504). For example, reservoir 411 may be coupled to supply port 321 (see FIG. 3) on printhead 100 via supply tube 415. With printhead 100 coupled to reservoirs 410-411 in this manner, delivery controller 440 controls one or both of pressure source 420-421 to create a pressure differential between reservoir 410 and reservoir 411 to produce a flow of the print fluid between reservoir 410 and reservoir 411 through printhead 100 (step 506). For example, delivery controller 440 may control pressure source 420 to apply a positive pressure at reservoir 410, and control pressure source 421 to apply a lower positive pressure or a negative pressure at reservoir 411. This pressure differential will cause the print fluid to flow in a first direction from reservoir 410 to reservoir 411 through printhead 100.

Delivery controller 440 then determines whether to reverse the flow of the print fluid (step 508). When the result of the determination is not to reverse the flow, delivery controller 440 maintains the pressure differential in step 506. When the result of the determination is to reverse the flow, delivery controller 440 controls one or both of pressures sources 420-421 to create a pressure differential between reservoir 410 and reservoir 411 to reverse the flow of the print fluid between reservoir 410 and reservoir 411 through printhead 100 (step 510). For example, delivery controller 440 may control pressure source 421 to apply a positive pressure at reservoir 411, and control pressure source 420 to apply a lower positive pressure or a negative pressure at reservoir 410. This pressure differential will cause the flow of print fluid to reverse direction and flow from reservoir 411 to reservoir 410 through printhead 100. Delivery controller 440 may repeat steps 508 and 510 to distribute the non-jetted print fluid between reservoir 410 and reservoir 411 while printhead 100 is in operation.

Figure 6:
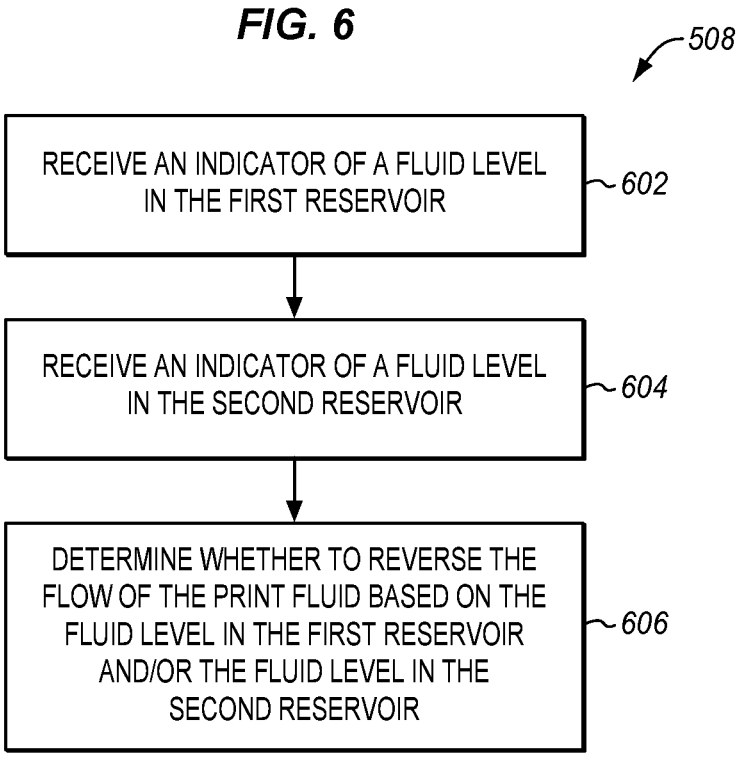
FIG. 6 is a flow chart illustrating a method of determining whether to reverse the flow of a print fluid in an illustrative embodiment.

Delivery controller 440 may determine whether to reverse the flow of the print fluid based on a number of factors. FIG. 6 is a flow chart illustrating a method 600 of determining whether to reverse the flow of the print fluid in an illustrative embodiment. Delivery controller 440 may receive an indicator of a fluid level in reservoir 410 (step 602). Delivery controller 440 may additionally or alternatively receive an indicator of a fluid level in reservoir 411 (step 604). Delivery controller 440 may then determine whether to reverse the flow of the print fluid based on the fluid level in reservoir 410 and/or the fluid level in reservoir 411 (step 606). For example, assume that the flow of the print fluid is initially from reservoir 410 to reservoir 411 through printhead 100. Delivery controller 440 may determine whether to reverse the flow of the print fluid based on whether the fluid level in reservoir 411 exceeds a threshold or the fluid level in reservoir 410 is lower than a threshold.

Figure 7:
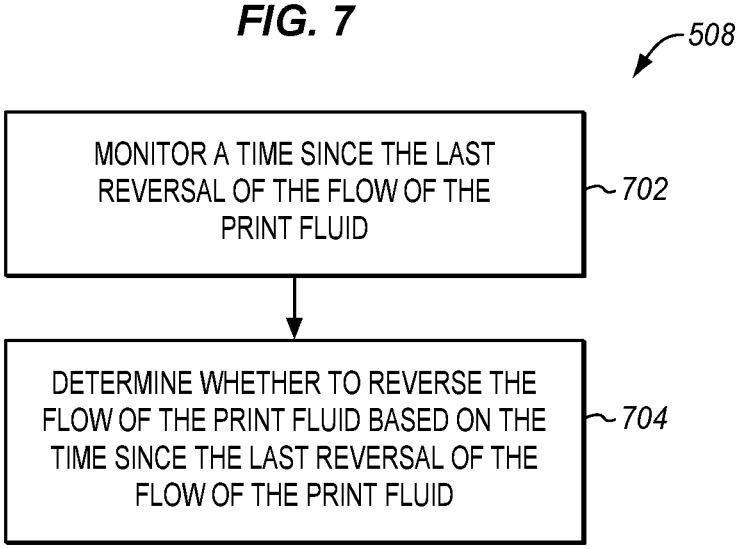
FIG. 7 is a flow chart illustrating another method of determining whether to reverse the flow of a print fluid in an illustrative embodiment.

FIG. 7 is a flow chart illustrating a method 700 of determining whether to reverse the flow of the print fluid in an illustrative embodiment. Delivery controller 440 may monitor a time since the last reversal of the flow of the print fluid (step 702). Delivery controller 440 may then determine whether to reverse the flow of the print fluid based on the time since the last reversal of the flow of the print fluid (step 704). For example, based on the size of reservoirs 410-411, an amount of print fluid in fluid supply system 402, a flow rate of the print fluid between reservoirs 410-411, etc., a threshold time may be established where the flow of print fluid is allowed in one direction. If the time since the last reversal of the flow of the print fluid exceeds the threshold, then delivery controller 440 may determine that reversal of the flow of the print fluid is needed or desired.

Figure 8:
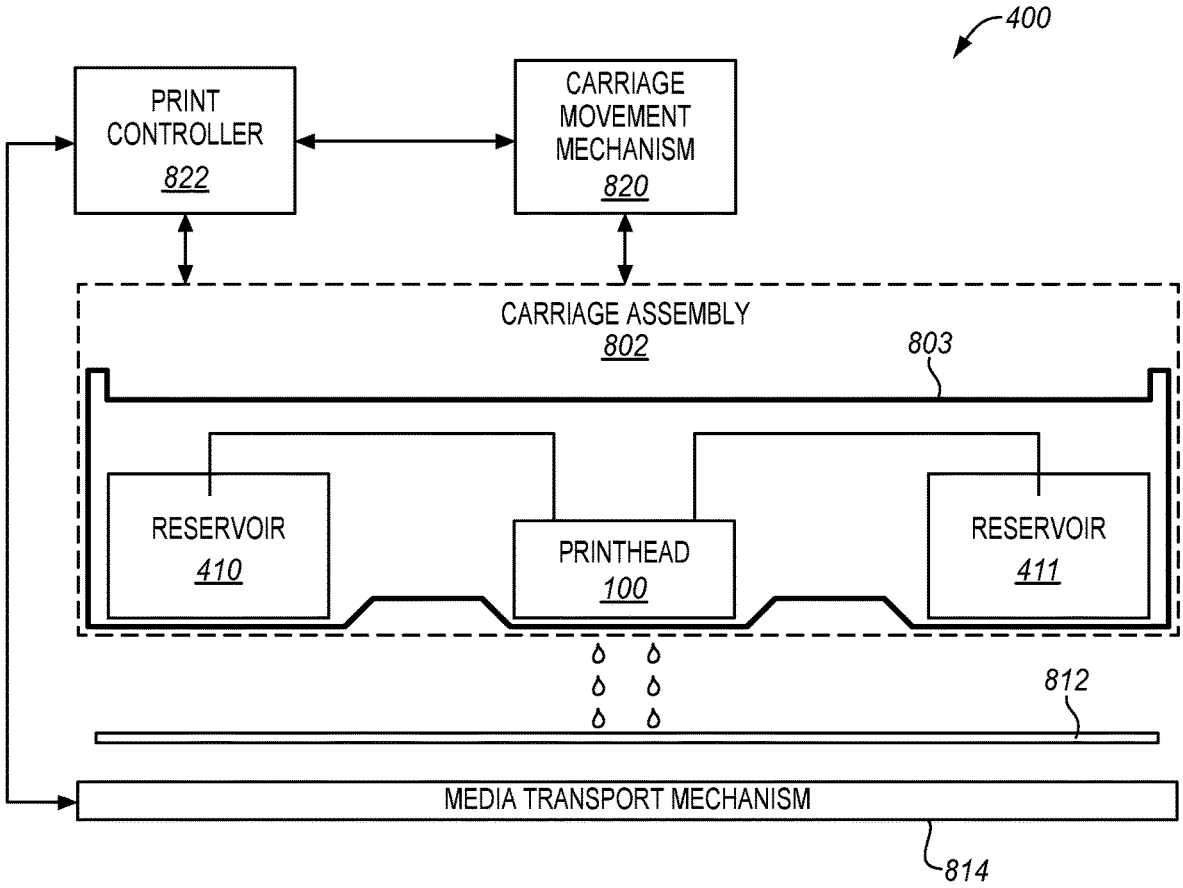
FIG. 8 is another schematic diagram of an image forming apparatus in an illustrative embodiment.

FIG. 8 is another schematic diagram of image forming apparatus 400 in an illustrative embodiment. In this embodiment, image forming apparatus 400 is a shuttle-type apparatus that includes a carriage assembly 802. Carriage assembly 802 includes a conveyance structure 803 that reciprocates back and forth along a scan line or scan directions during operation. One or more printheads 100 are mounted on conveyance structure 803, and independent reservoirs 410-411 are also mounted on conveyance structure 803. Conveyance structure 803 may comprise any desired structure for mounting printhead 100 and reservoirs 410-411. Other components of fluid supply system 402 (see FIG. 4) may also be mounted on conveyance structure 803. The shape of conveyance structure 803 may vary as desired. In one embodiment, conveyance structure 803 may have the shape or profile of an inkjet cartridge or pen that are used in a printer.

The droplets ejected from the nozzles of printhead 100 are directed toward a medium 812. Medium 812 comprises any type of material upon which ink or another print fluid is applied by a printhead, such as paper, card stock, transparent sheets, a substrate for 3D printing, cloth, etc. Ejection of print fluid from the nozzles of printhead 100 causes formation of characters, symbols, images, layers of an object, etc., on medium 812 as printhead 100 and medium 812 are moved relative to one another. Media transport mechanism 814 moves medium 812 relative to printhead 100.

In this embodiment, carriage assembly 802 reciprocates back and forth across a surface of medium 812 (e.g., into and out of the page in FIG. 8). To provide the movement of carriage assembly 802, image forming apparatus 400 includes a carriage movement mechanism 820 that moves carriage assembly 802 relative to medium 812 to perform print operations. For example, carriage movement mechanism 820 may include one or more elongated rods, and carriage assembly 802 may be slidably mounted to the elongated rods to move bi-directionally over the medium 812. Carriage movement mechanism 820 may also include an actuator that slides carriage assembly 802 along the elongated rods.

Image forming apparatus 400 also includes a print controller 822 that communicates with carriage assembly 802, media transport mechanism 814, and carriage movement mechanism 820. Print controller 822 may connect to a data source to receive printable data. Print controller 822 then controls carriage assembly 802, media transport mechanism 814, and carriage movement mechanism 820 to print the printable data on medium 812 via printhead 100.

Figure 9:
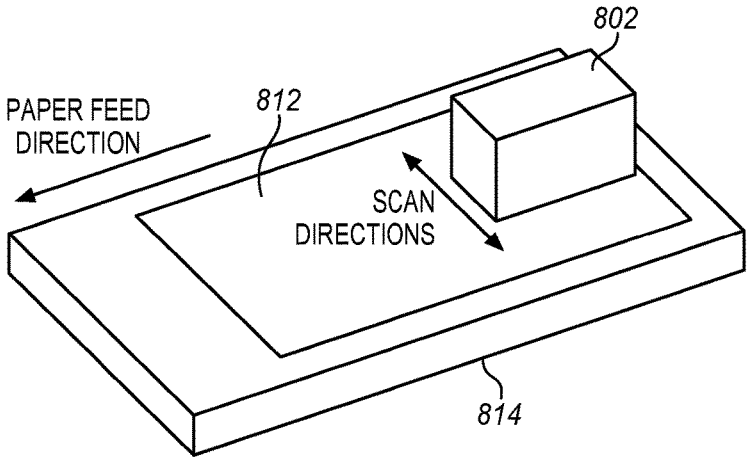
FIG. 9 is a perspective view of a carriage assembly moving in relation to a medium in an illustrative embodiment.

FIG. 9 is a perspective view of carriage assembly 802 moving in relation to medium 812 in an illustrative embodiment. Medium 812 is fed along the paper feed direction by media transport mechanism 814. Carriage assembly 802 is driven to move in reciprocation along the scan directions, which are substantially perpendicular to the paper feed direction (or sub-scan direction). The drive mechanism for carriage assembly 802 is beyond the scope of this specification, but may include a motor, a drive belt, guide rails, etc.

Figure 10:
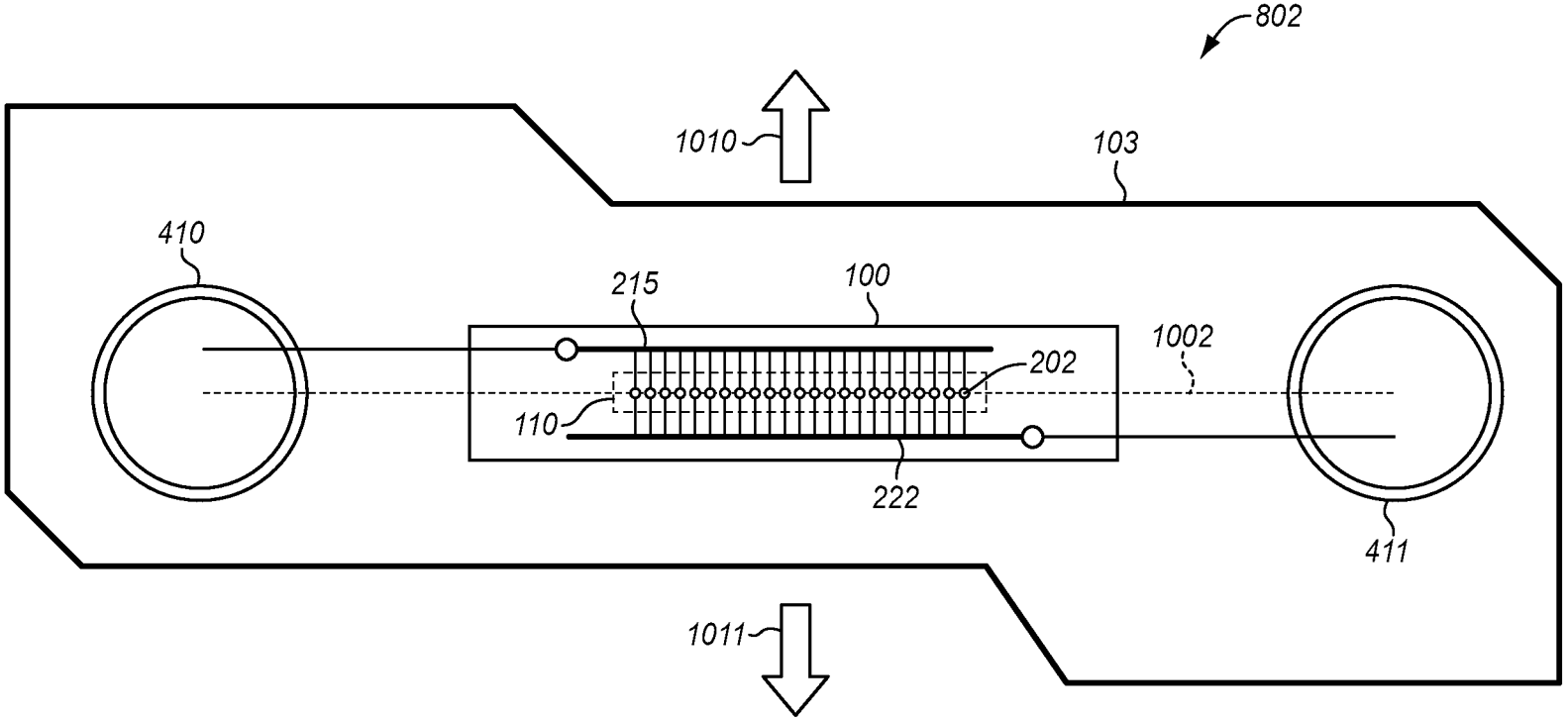
FIG. 10 is a top schematic view of a carriage assembly in an illustrative embodiment.

In one embodiment, reservoirs 410-411 may be mounted to carriage assembly 802 along with printhead 100, and in-line with the row 110 of jetting channels 202 on printhead 100. FIG. 10 is a top schematic view of carriage assembly 802 in an illustrative embodiment. Reservoir 410 is fluidly coupled to supply manifold 215 of printhead 100, and reservoir 411 is fluidly coupled to return manifold 222 of printhead 100. In this embodiment, reservoirs 410-411 are mounted an opposite sides of carriage assembly 802 (i.e., opposite sides of printhead 100), but reservoirs 410-411 may be mounted on the same side of printhead 100. Also in this embodiment, reservoirs 410-411 are in-line with the row 110 of jetting channels 202. The arrangement of jetting channels 202 defines an axis 1002 for the row 110. Axis 1002 represents a line of direction or orientation of jetting channels 202 in the row 110. Reservoir 410 and reservoir 411 are mounted to be substantially centered on axis 1002. When reservoirs 410-411 are in-line as in this embodiment, acceleration or changes of direction of carriage assembly 802 along the scan directions 1010-1011 does not create any pressure differential between reservoirs 410-411. Thus, the pressure at reservoirs 410-411 and flow of print fluid between reservoirs 410-411 are tightly controlled by delivery controller 440 and is not influenced by the movement of carriage assembly 802.

Reservoirs 410-411 may be mounted higher or lower than printhead 100 depending on printer design. A height difference between reservoirs 410-411 may create a pressure delta that can cause a flow of print fluid through printhead 100 in one direction. In such a case, delivery controller 440 is configured to control pressure sources 420-421 to compensate for the height difference between reservoirs 410-411 and maintain a slightly negative pressure at nozzles 214 while the print fluid flows in one direction. Delivery controller 440 is also configured to control pressure sources 420-421 to overcome the pressure delta due to the height difference between reservoirs 410-411, and reverse the flow of print fluid through printhead 100 while maintaining a slightly negative pressure at nozzles 214.

Any of the various elements or modules shown in the figures or described herein may be implemented as hardware, software, firmware, or some combination of these. For example, an element may be implemented as dedicated hardware. Dedicated hardware elements may be referred to as "processors", "controllers", or some similar terminology. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, a network processor, application specific integrated circuit (ASIC) or other circuitry, field programmable gate array (FPGA), read only memory (ROM) for storing software, random access memory (RAM), non-volatile storage, logic, or some other physical hardware component or module.

Also, an element may be implemented as instructions executable by a processor or a computer to perform the functions of the element. Some examples of instructions are software, program code, and firmware. The instructions are operational when executed by the processor to direct the processor to perform the functions of the element. The instructions may be stored on storage devices that are readable by the processor. Some examples of the storage devices are digital or solid-state memories, magnetic storage media such as a magnetic disks and magnetic tapes, hard drives, or optically readable digital data storage media.

Although specific embodiments were described herein, the scope of the invention is not limited to those specific embodiments. The scope of the invention is defined by the following claims and any equivalents thereof

What is claimed is:

1. An apparatus comprising:

a flow-through printhead having a row of jetting channels configured to jet droplets of a print fluid, a supply manifold within the printhead that is fluidly coupled to the row of jetting channels, and a return manifold within the printhead that is fluidly coupled to the row of jetting channels, wherein each of the jetting channels includes a nozzle, a pressure chamber, a first restrictor that fluidly connects the pressure chamber to the supply manifold, and a second restrictor that fluidly connects the pressure chamber to the return manifold; and a fluid supply system comprising:

a first reservoir fluidly coupled to the supply manifold;

a second reservoir fluidly coupled to the return manifold, wherein the first reservoir and the second reservoir are fluidly isolated except through the printhead; and a controller configured to control at least one pressure source to create a first pressure differential between the first reservoir and the second reservoir to produce a flow of the print fluid through the jetting channels of the printhead in a first direction, and to create a second pressure differential between the first reservoir and the second reservoir to produce the flow of the print fluid through the jetting channels of the printhead in a second direction that is opposite the first direction;

wherein the controller is configured to distribute non-jetted print fluid between the first reservoir and the second reservoir by repeatedly determining whether to reverse the flow of the print fluid between the first direction and the second direction; maintaining the first pressure differential or the second pressure differential responsive to a determination not to reverse the flow, and reversing from the first pressure differential to the second pressure differential or from the second pressure differential to the first pressure differential responsive to a determination to reverse the flow.

2. The apparatus of claim 1 wherein the fluid supply system further comprises:

a first pressure source at the first reservoir; and a second pressure source at the second reservoir;

wherein the controller is configured to control the first pressure source and the second pressure source to create the first pressure differential between the first reservoir and the second reservoir to produce the flow of the print fluid from the first reservoir to the second reservoir through the jetting channels of the printhead in the first direction.

3. The apparatus of claim 2 wherein:

the controller is configured to control the first pressure source and the second pressure source to create the second pressure differential between the first reservoir and the second reservoir to produce the flow of the print fluid from the second reservoir to the first reservoir through the jetting channels of the printhead in the second direction.

4. The apparatus of claim 3 wherein:

the controller is configured to control the first pressure source to apply a positive pressure at the first reservoir, and to control the second pressure source to apply a negative pressure at the second reservoir to produce the flow of the print fluid in the first direction.

5. The apparatus of claim 4 wherein:

the controller is configured to control the first pressure source to apply a negative pressure at the first reservoir, and to control the second pressure source to apply a positive pressure at the second reservoir to produce the flow of the print fluid in the second direction.

6. The apparatus of claim 3 wherein the fluid supply system further comprises:

a first fluid level sensor at the first reservoir; and a second fluid level sensor at the second reservoir;

wherein the controller is communicatively coupled to the first fluid level sensor and the second fluid level sensor;

wherein the controller is configured to receive a first indicator of a fluid level in the first reservoir from the first fluid level sensor, to receive a second indicator of a fluid level in the second reservoir from the second fluid level sensor, and to determine whether to reverse the flow of the print fluid based on at least one of the fluid level in the first reservoir and the fluid level in the second reservoir.

7. The apparatus of claim 3 wherein:

the controller is configured to monitor a time since a last reversal of the flow of the print fluid, and to determine whether to reverse the flow of the print fluid based on the time since the last reversal of the flow of the print fluid.

8. The apparatus of claim 1 wherein:

the printhead, the first reservoir, and the second reservoir are mounted on a carriage assembly that is configured to reciprocate along scan directions in relation to a medium; and the first reservoir and the second reservoir are mounted in-line with the row of jetting channels.

9. An apparatus comprising:

a carriage assembly configured to reciprocate along scan directions in relation to a medium, the carriage assembly comprising:

a flow-through printhead having a row of jetting channels configured to eject a print fluid, a supply manifold within the printhead that is fluidly coupled to the row of jetting channels, and a return manifold within the printhead that is fluidly coupled to the row of jetting channels;

a first reservoir fluidly coupled to the supply manifold of the printhead; and a second reservoir fluidly coupled to the return manifold of the printhead;

wherein the first reservoir and the second reservoir are mounted in-line with the row of jetting channels;

wherein the supply manifold is fluidly coupled to the return manifold through the jetting channels;

wherein the second reservoir is fluidly coupled to the first reservoir solely through the jetting channels of the printhead with no additional fluid couplings between the first reservoir and the second reservoir for the print fluid; and a controller configured to control at least one pressure source to create a first pressure differential between the first reservoir and the second reservoir to produce a flow of the print fluid from the supply manifold through the jetting channels to the return manifold in a first direction, and to create a second pressure differential between the first reservoir and the second reservoir to produce the flow of the print fluid from the return manifold through the jetting channels to the supply manifold in a second direction;

wherein the controller is configured to distribute non-jetted print fluid between the first reservoir and the second reservoir by repeatedly determining whether to reverse the flow of the print fluid between the first direction and the second direction, maintaining the first pressure differential or the second pressure differential responsive to a determination not to reverse the flow, and reversing from the first pressure differential to the second pressure differential or from the second pressure differential to the first pressure differential responsive to a determination to reverse the flow.

10. The apparatus of claim 9 further comprising:

a first pressure source at the first reservoir; and a second pressure source at the second reservoir;

wherein the controller is configured to control the first pressure source and the second pressure source to create the first pressure differential between the first reservoir and the second reservoir to produce the flow of the print fluid in the first direction.

11. The apparatus of claim 10 wherein:

the controller is configured to control the first pressure source and the second pressure source to create the second pressure differential between the first reservoir and the second reservoir to produce the flow of the print fluid in the second direction.

12. The apparatus of claim 11 wherein:

the controller is configured to control the first pressure source to apply a positive pressure at the first reservoir, and to control the second pressure source to apply a negative pressure at the second reservoir to produce the flow of the print fluid in the first direction.

13. The apparatus of claim 12 wherein:

the controller is configured to control the first pressure source to apply a negative pressure at the first reservoir, and to control the second pressure source to apply a positive pressure at the second reservoir to produce the flow of the print fluid in the second direction.

14. The apparatus of claim 11 further comprising:

a first fluid level sensor at the first reservoir; and a second fluid level sensor at the second reservoir;

wherein the controller is communicatively coupled to the first fluid level sensor and the second fluid level sensor;

wherein the controller is configured to receive a first indicator of a fluid level in the first reservoir from the first fluid level sensor, to receive a second indicator of the fluid level in the second reservoir from the second fluid level sensor, and to determine whether to reverse the flow of the print fluid based on at least one of the fluid level in the first reservoir and the fluid level in the second reservoir.

15. The apparatus of claim 11 wherein:

the controller is configured to monitor a time since a last reversal of the flow of the print fluid, and to determine whether to reverse the flow of the print fluid based on the time since the last reversal of the flow of the print fluid.

16. A method of supplying a print fluid to a flow-through printhead having a row of jetting channels configured to eject a print fluid, a supply manifold within the printhead that is fluidly coupled to the row of jetting channels, and a return manifold within the printhead that is fluidly coupled to the row of jetting channels, wherein each of the jetting channels includes a nozzle, a pressure chamber, a first restrictor that fluidly connects the pressure chamber to the supply manifold, and a second restrictor that fluidly connects the pressure chamber to the return manifold, the method comprising:

fluidly coupling a first reservoir to the supply manifold of the printhead;

fluidly coupling a second reservoir to the return manifold of the printhead, wherein the first reservoir and the second reservoir are fluidly isolated except through the printhead;

controlling at least one pressure source to create a first pressure differential between the first reservoir and the second reservoir to produce a flow of the print fluid through the jetting channels of the printhead in a first direction, or to create a second pressure differential between the first reservoir and the second reservoir to produce the flow of the print fluid through the jetting channels of the printhead in a second direction that is opposite the first direction;

wherein the controlling includes distributing non-jetted print fluid between the first reservoir and the second reservoir by repeatedly:

determining whether to reverse the flow of the print fluid between the first direction and the second direction;

maintaining the first pressure differential or the second pressure differential responsive to a determination not to reverse the flow; and reversing from the first pressure differential to the second pressure differential or from the second pressure differential to the first pressure differential responsive to a determination to reverse the flow.

17. The method of claim 16 wherein creating the first pressure differential between the first reservoir and the second reservoir comprises:

applying a positive pressure at the first reservoir; and applying a negative pressure at the second reservoir to produce the flow of the print fluid in the first direction from the first reservoir to the second reservoir through the jetting channels of the printhead.

18. The method of claim 17 wherein creating the second pressure differential between the first reservoir and the second reservoir comprises:

applying a negative pressure at the first reservoir; and applying a positive pressure at the second reservoir to produce the flow of the print fluid in the second direction from the second reservoir to the first reservoir through the jetting channels of the printhead.

19. The method of claim 16 wherein determining whether to reverse the flow of the print fluid comprises:

receiving a first indicator of a fluid level in the first reservoir;

receiving a second indicator of a fluid level in the second reservoir; and determining whether to reverse the flow of the print fluid based on at least one of the fluid level in the first reservoir and the fluid level in the second reservoir.

20. The method of claim 16 wherein determining whether to reverse the flow of the print fluid comprises:

monitoring a time since a last reversal of the flow of the print fluid; and determining whether to reverse the flow of the print fluid based on the time since the last reversal of the flow of the print fluid.

* * * * *